United States Patent [19]

Epstein

[11] 4,205,720

[45] Jun. 3, 1980

[54] HEAT TRANSFER CONDUIT

[76] Inventor: Joseph Epstein, 1524 Elbridge St., Philadelphia, Pa. 19149

[21] Appl. No.: 1,140

[22] Filed: Jan. 5, 1979

[51] Int. Cl.[2] ..... F28D 1/06

[52] U.S. Cl. ..... 165/169

[58] Field of Search ..... 165/169

[56] References Cited

U.S. PATENT DOCUMENTS

| | | | |
|---|---|---|---|
| 2,219,072 | 10/1940 | King | 165/169 |
| 2,772,860 | 12/1956 | Nelson | 165/169 |
| 3,054,729 | 9/1962 | Smith | 165/169 |
| 3,318,376 | 5/1967 | Vihl | 165/169 |
| 3,871,446 | 3/1975 | Langenberg | 165/169 |

FOREIGN PATENT DOCUMENTS

| | | | |
|---|---|---|---|
| 567443 | 12/1932 | Fed. Rep. of Germany | 165/169 |
| 635970 | 9/1936 | Fed. Rep. of Germany | 165/169 |
| 1066524 | 10/1959 | Fed. Rep. of Germany | 165/169 |
| 1095865 | 12/1960 | Fed. Rep. of Germany | 165/169 |

*Primary Examiner*—Sheldon Richter

*Attorney, Agent, or Firm*—Seidel, Gonda, Goldhammer & Panitch

[57] ABSTRACT

A heat transfer conduit for attachment to the end of a heat transfer vessel is arranged as a spiral and has a uniform distance between adjacent coils. The conduit has a uniform cross-section with an arcuate periphery of between 130° and 150° of a circle.

4 Claims, 3 Drawing Figures

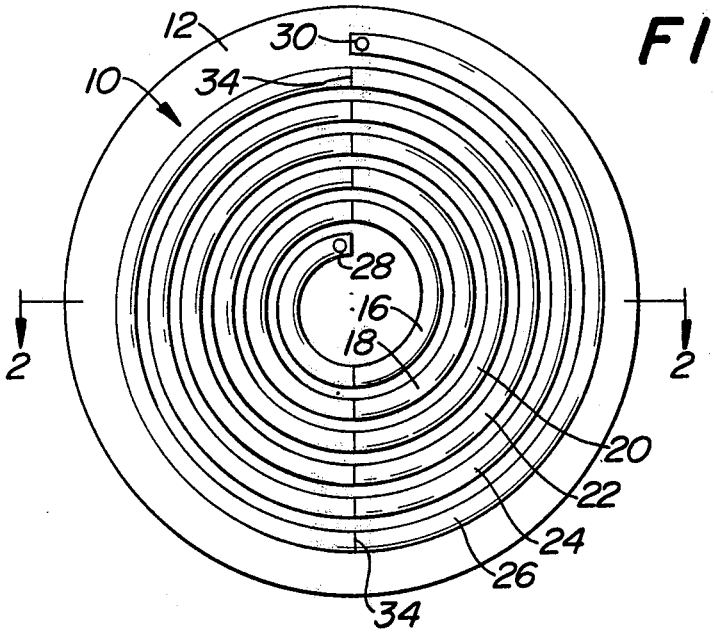
FIG. 1
FIG. 2
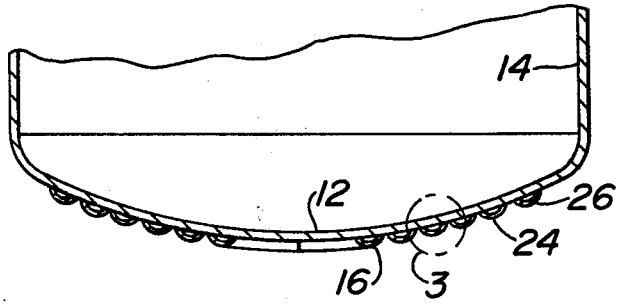
FIG. 3
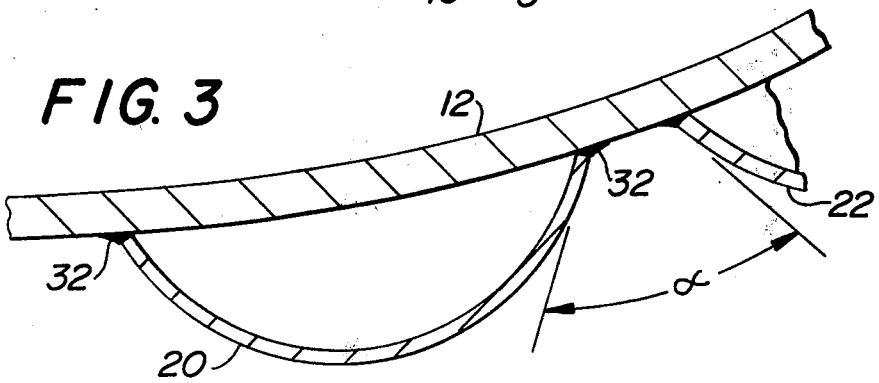

HEAT TRANSFER CONDUIT

BACKGROUND

Heat transfer coils of the type involved herein are known, for example, from FIG. 9 of U.S. Pat. No. 3,318,376. I have found that the generally U-shaped conduit with flared side edges as shown in FIG. 9 of said patent is objectionable because of the bending stresses introduced into the conduit as a result of the flared side edge portions. The bending stresses introduced into the conduit is a result of cyclical pressure and temperature changes which results in early failure due to fatigue. While the prior art uses conduits which are semi-circular in cross-section so as to have arcuate periphery of 180° or more, I have found that a conduit which has an arcuate periphery of less than about 150° produces a number of advantages not attainable with the prior art conduits.

SUMMARY OF THE INVENTION

The present invention is directed to a heat transfer conduit for attachment by welding to the end of a vessel. The conduit is made of metal and arranged as a spiral having a uniform distance between adjacent coils. The conduit has a uniform cross-section with an arcuate periphery of betwen 130° and 150° of a circle. The conduit has an inlet at one end and an outlet at its other end.

The conduit may be flat, disk-shaped or conically shaped so as to match the configuration of the end wall of the vessel to which it is to be attached. The novel structural interrelationship of the heat transfer conduit of the present invention facilitates attachment of the coil by welding to an end wall having any of those shapes.

It is an object of the present invention to provide a heat transfer conduit which uses less metal than the prior art, provides for more uniform flow, provides for easier access for welding while being subject only to tensile stresses.

It is another object of the present invention to provide a heat transfer conduit which is easier and cheaper to manufacture.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is an end view of a vessel to which a heat transfer conduit in accordance with the present invention has been attached.

FIG. 2 is a sectional view taken along the line 2—2 in FIG. 1.

FIG. 3 is an enlarged detail view of the structure shown within the circle in FIG. 2.

Referring to the drawings in detail, wherein like numerals indicate like elements, there is shown in FIG. 1 a heat transfer conduit in accordance with the present invention designated generally as 10. The conduit 10 is a metal conduit preferably made from any one of a wide variety of good heat transfer materials.

As shown more clearly in FIG. 2, the coil 10 is welded to the end face of an end wall 12 on the vessel 14. The outer peripheral surface of the vessel 14 may also be provided with a heat transfer conduit. The conduit 10 is arranged in a form of a spiral with a uniform distance between adjacent coils. The number of coils will vary depending upon the size of the end wall 12. As illustrated in FIGS. 1 and 2, the conduit 10 has coils designated 16, 18, 20, 22, 24 and 26. Conduit 10 has an inlet at one end and an outlet at the other end. For example, one end is designated 28 and may be the inlet end while the other end is designated 30 and may be the outlet end. The inlet and outlet ends may be reversed.

As shown more clearly in FIGS. 2 and 3, the coils of the conduit 10 are all of uniform cross-section with an arcuate periphery of between 130° and 150° of a circle. As a result thereof, the angle designated as $\alpha$ is substantially greater than the corresponding angle if the coils constituted 180° of a circle. Due to the substantially enlarged angle $\alpha$, welds 32 may be applied easier and faster and may be closer together. Each coil is welded at 32 along its side edges to the end wall 12. Due to the fact that the coils in section have a periphery of between 130° and 150° of a circle, they are subjected only to tensile stresses and not to bending stresses. The uniform periphery allows for uniform flow which minimizes turbulence and pressure drop thereby maximizing heat transfer.

The side edges of the coils such as coil 30 are on a radius thereby presenting a beveled edge for better penetration of the weld 32. In a typical embodiment, wherein the preferred arcuate extent of the periphery of coil 20 is 136°, the chordal distance between the side edges of the coil is 3¼ inches and the arcuate periphery is 4 inches.

The preferred method of making the conduit 10 is to shape a flat disk which is semi-circular and form one-half of a coil. The second half of each coil as shown at the righthand side of FIG. 1 is formed in a similar manner but on a larger diameter. Then the coil halves are welded end to end as indicated at 34 thereby forming the spiral arrangement. This method uses less material and eliminates the necessity for the high cost involved in using pressing dies, cutting preformed full pipe cylindrical conduits, and other methods which result in waste of material. Reduction in waste can be significant when the conduit 10 is made from expensive material such as Inconel, stainless steel, etc.

The coil segments are formed to fit the changing contour of the vessel end wall 12 without any additional shaping as is present in prior art methods. Therefore, the coils of the present invention are not subjected to stresses and/or corrosion in the same amount as the prior art.

The heat transfer conduit of the present invention may be utilized in connection with a variety of different fluids including gases and liquids. When the fluid is a gas, the inlet is at 30. When the fluid is a liquid, the inlet is at 28.

The present invention may be embodied in other specific forms without departing from the spirit or essential attributes thereof and, accordingly, reference should be made to the appended claims, rather than to the foregoing specification, as indicating the scope of the invention.

I claim:

1. A heat transfer conduit for attachment by welding to the end of a vessel comprising a metal conduit arranged as a spiral having a uniform distance between adjacent coils, said conduit having a uniform cross-section with an arcuate periphery of between 130° and 150° of a circle, the side edges of said coils lying along a radius of the circle associated therewith, said conduit having an inlet at one end and an outlet at its other end.

2. A heat transfer conduit in accordance with claim 1 wherein said conduit is shaped so that the open side of the conduit may be juxtaposed to a curved surface at the end of a vessel.

3. A heat transfer conduit in accordance with claim 1 wherein the coils thereof when viewed in plan are two semi-circular halfs welded together in an end to end relationship to form a continuous spiral between the inlet and the outlet.

4. Apparatus comprising a conduit in accordance with claim 1 including a vessel having an end wall, the side edges of said coils being welded to said end wall.

* * * * *